US006837735B1

(12) United States Patent
Dessein et al.

(10) Patent No.: US 6,837,735 B1
(45) Date of Patent: Jan. 4, 2005

(54) RF CONNECTOR WITH CUTTING EDGES

(75) Inventors: Jan Dessein, Blankerberge (BE); Marcus Schulte, Heppenheim (DE); Martin Strab, Neusaess (DE); Edgard Acke, Oostkamp (BE); Joris Dobbelaere, Beernem (BE); Bernard Houtteman, Oostkamp (BE); Tom Blomme, Moorsele (BE)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/701,349

(22) PCT Filed: Mar. 25, 1999

(86) PCT No.: PCT/DE99/00918

§ 371 (c)(1),
(2), (4) Date: Mar. 28, 2002

(87) PCT Pub. No.: WO99/62141

PCT Pub. Date: Dec. 2, 1999

(Under 37 CFR 1.47)

(30) Foreign Application Priority Data

May 28, 1998 (DE) ..... 198 23 957

(51) Int. Cl.[7] ..... H01R 11/20
(52) U.S. Cl. ..... 439/394; 439/405
(58) Field of Search ..... 439/394, 405, 439/409, 417, 401, 397

(56) References Cited

U.S. PATENT DOCUMENTS 3,521,221 A * 7/1970 Lenaerts et al. ..... 439/402
4,097,107 A 6/1978 Hawkins
4,701,001 A 10/1987 Verhoeven
4,909,754 A * 3/1990 Paradis ..... 439/395
5,441,422 A * 8/1995 Steiner ..... 439/395
5,588,859 A 12/1996 Maurice
5,836,782 A * 11/1998 Odley et al. ..... 439/395
6,086,407 A * 7/2000 Daoud ..... 439/405
6,328,592 B1 * 12/2001 Burke et al. ..... 439/404

FOREIGN PATENT DOCUMENTS

EP 0121224 A1 10/1984
EP 0470882 A1 2/1992
EP 0525457 A2 2/1993
EP 0525457 A3 5/1993
EP 0525457 B1 3/1996

OTHER PUBLICATIONS

Copy of Corresponding Search Report for Parent Case No. PCT/DE99/00918) dated Sep. 6, 1999.

* cited by examiner

*Primary Examiner*—Gary Paumen
*Assistant Examiner*—Edwin A. Leon
(74) *Attorney, Agent, or Firm*—Baker & Daniels

(57) ABSTRACT

The invention relates to a connector for RF lines for contacting the outer conductor (8) of the RF line (3) by means of an insulation displacement connector having at least one pair of opposite cutting edges (2), with the cutting edges (2) being arranged opposite each other in staggered manner in the longitudinal axial direction of the outer conductor (8).

14 Claims, 3 Drawing Sheets

RF CONNECTOR WITH CUTTING EDGES

BACKGROUND OF INVENTION

1. Field of the Invention

The present invention relates to a connector for RF lines according to the generic clause of claim 1.

2. Discussion of the Prior Art

Connectors of the insulation displacement type are known which establish contact with a conductor via cutting edges, for example for tapping a signal from the conductor or for connecting two conductors to each other via such a connector. Such known connectors are used in all situations where it is necessary to provide an inexpensive solution for establishing an electrically conductive connection between connector and conductor.

With such a type of connection, cutting edges of metal quite generally penetrate the shield of the line until the cutting edges establish contact with the conductor. In this manner it is possible, for example, to establish an electrically conducting connection between two lines whose shields are penetrated by the cutting edges of the connector so that the two conductors are in electrical contact via the cutting edges.

Such connectors making use of the insulation displacement technique have proven efficient as they can be manufactured inexpensively, can rapidly be contacted with a conductor and moreover as a rule establish good electrical contact.

There has also become known a connector for RF lines in which a cutting edge pair is arranged such that the end faces of the two cutting edges are located exactly opposite each other, i.e. the cutting edge pair is disposed in one plane with respect to the RF line. Such RF lines are employed in cases in which large amounts of data or signals are to be transferred, resulting in correspondingly high frequencies on the conductor.

A possible field of application for such RF lines is also automotive engineering in which large data quantities and wave signals are to be transferred for audio systems and multimedia applications from the fields of communication or navigation.

Due to the forces originating on the basis of the dynamics of the vehicle movement of a motor vehicle from vibrations and shocks, such a connector also is exposed to corresponding forces resulting in release of the contact between the cutting edges and the conductor. This danger of release of the connection between the cutting edges and the conductor still is increased considerably due to the high temperature fluctuations which often occur in motor vehicles, as these temperature fluctuations result in different degrees of expansion of the cutting edges and the conductor.

For example, due to differing coefficients of expansion of the conductor and the cutting edges, displacement of the cutting edges with respect to the conductor may occur, thereby changing the transition resistance and thus causing different potentials or erroneous contacting. The signal tapped from the conductor is distorted.

For eliminating the disadvantages outlined, it is thus the object of the invention to provide a connector which, while basically maintaining the utilization of the insulation displacement technique, permits unaltered contacting with the conductor also in case of temperature fluctuations and vibrations.

SUMMARY OF THE INVENTION

This object is met by the invention by the features indicated in claim 1. Advantageous development thereof are described in the further claims.

The present invention is based on the realization that the insulation displacement type connection between the cutting edges and the conductor establishes a cold-welding type connection and that this connection is disturbed in case of relative motion between the cutting edges and the conductor due to the thus arising gap between the cutting edges and the conductor. There is formed an air gap that changes the electrical resistance at the contact location between the cutting edges and the conductor. There are potential differences arising at the contact location.

According to the invention, a connector for RF lines, for establishing contact with the outer conductor of the RF line by way of an insulation displacement connection, is provided with at least one pair of opposite cutting edges, with the cutting edges being arranged opposite each other in staggered manner in the longitudinal axial direction of the outer conductor. The RF line preferably is a coaxial cable.

The expression concerning the opposite and staggered arrangement of the cutting edges, in the sense of the invention, is to be understood to the effect that the cutting edges indeed are basically located opposite each other at the RF line, but that the cutting edges, contrary to the known connector, are not arranged end face on end face, but rather one after the other as seen in the longitudinal axial direction of the conductor, i.e. in spaced apart manner.

The effect achieved by this design is that the cutting edges, after penetration of the outer insulation of the RF line, establish a cold-welding type connection with the outer conductor on the end face and at least one adjacent side face. The contact-establishing area between the cutting edges and the outer conductor is considerably increased thereby.

It is provided according to a further development of the invention that the connector has a plurality of cutting edge pairs arranged symmetrically with respect to a plane extending perpendicularly to the longitudinal axial direction of the outer conductor. The effect achieved hereby is that, when establishing the insulation displacement type connection, the RF line between the cutting edges of the connector is not acted upon by a tensile force extending in the longitudinal axial direction of the outer conductor and resulting in a shear effect of the line, but rather is slightly upset between the cutting edges.

The connector may have a plurality of cutting edge pairs arranged symmetrically with respect to a plane extending along the longitudinal axial direction of the outer conductor, such that a design of the connector that is mirror-symmetrical with respect to both planes is rendered possible so that only one half of the connector has to be manufactured and two halves thereof can be mated with each other via the cutting edges in order to thus establish the connector.

The increased contact area between the cutting edges and the conductor has the effect that the cutting edges, in case of a change in distance of their end faces with respect to each other, slide on the outer conductor without a gap being formed between outer conductor and cutting edges, as the sliding area is formed largely by the lateral area of the respective cutting edge.

BRIEF DESCRIPTION OF THE DRAWINGS

The invention will be elucidated in the following by way of the drawings in which.

DETAILED DESCRIPTION OF THE INVENTION

Figure 1:
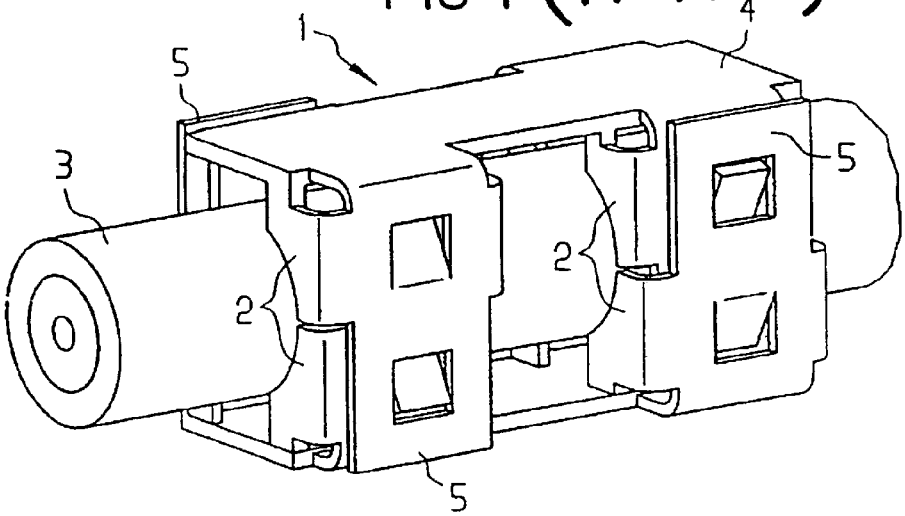
FIG 1 (Prior Art)
FIG. 1 shows a perspective view of a conventional connector.
Figure 2:
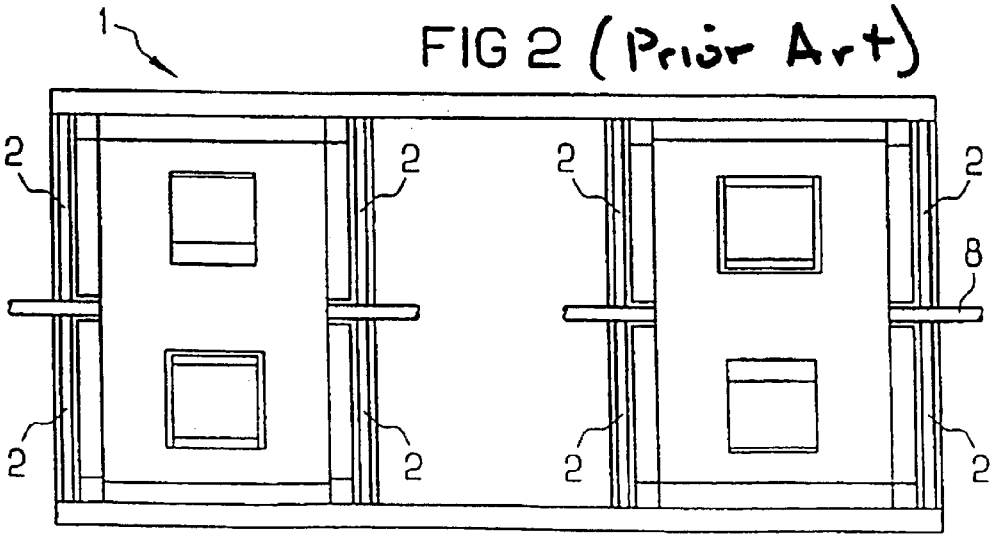
FIG 2 (Prior Art)
FIG. 2 shows a schematic side view of the connector of FIG. 1.

FIG. 1 and FIG. 2 of the drawings illustrate a known connector 1 having cutting edges 2 arranged in confronting manner on the face sides thereof.

The connector 1 comprises a largely rectangular base plate 4 having respective lugs 5 formed on the longitudinal sides thereof, such that connector 1 has a U-shaped configuration as seen in front view. Both legs of the thus formed U-shaped arrangement are constituted by said lugs 5 which enclose the RF line 3.

As can be seen more clearly by way of drawing FIG. 2, the cutting edges 2 of connector 1 extend in one plane each, so that the outer conductor 8 clamped between the cutting edges 2 is gripped only by the respective end faces of cutting edges 2, so that, for example, in case of a change in distance between the cutting edges 2 due to temperature fluctuations, a gap is formed in the contact area between the cutting edges 2 and the outer conductor 8, with potential differences or erroneous contacting being the result thereof.

Figure 3:
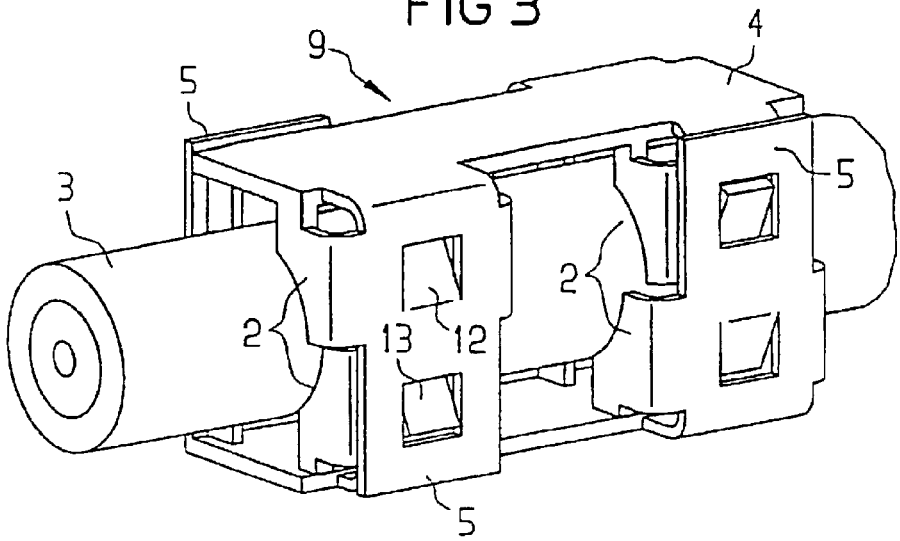
FIG. 3 shows a perspective view of a connector according to the invention.
Figure 4:
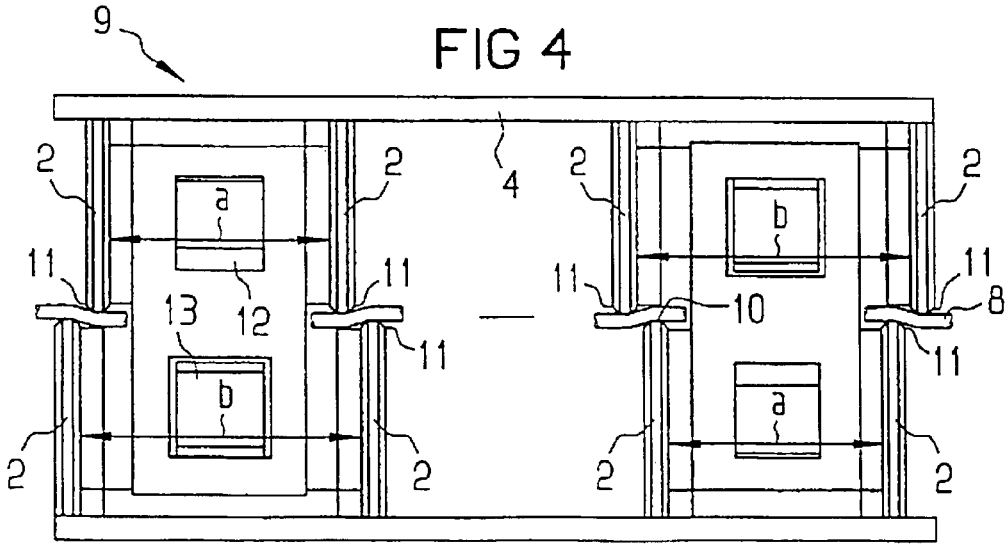
FIG. 4 shows a schematic side view of the connector of FIG. 3.

FIGS. 3 and 4 of the drawings illustrate a connector 9 according to the invention, which is formed largely similar to the known connector 1 and thus has the advantage that it can be clampingly engaged using already existing tools.

A significant difference between the known connector according to FIG. 1 and FIG. 2 and the inventive connector 9 according to FIG. 3 and FIG. 4, however, resides in that—as clearly visible from FIG. 4—the cutting edges 2 are not arranged with their end faces in confronting manner on top of each other, but rather extend in staggered manner in the longitudinal axial direction of the conductor 3.

Figure 5:
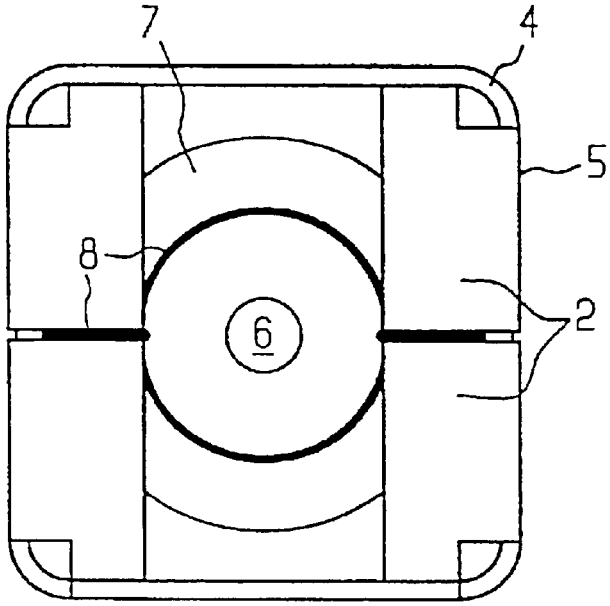
FIG. 5 shows a front view illustrating the manner in which the outer conductor is clamped between the cutting edges of the connector.

From the base plate 4 of connector 9, there are extending lugs 5 for establishing a largely U-shaped configuration of connector 9, said lugs 5 enclosing the RF line 3. The cutting edges 2 are extending from the lugs 5 in an angle substantially perpendicular to the longitudinal axial direction of conductor 3 in the direction towards the inner conductor 6 (cf. FIG. 5) and in doing so penetrate the outer insulation 7 of conductor 3 and are clampingly and squeezingly engaged with the outer conductor 8. As also shown in FIG. 5, the edges 2 have side faces 15 generally aligned along a vertical axis Y which forms a cable receiving area 16.

As can be seen more clearly from FIG. 4, the axially staggered arrangement of the cutting edges 2 does not only result in contact between the respective end faces 10 of cutting edges 2 and the outer conductor 8, but also in face-to-face contact between the side faces 11 of the cutting edges 2 and the outer conductor 8.

This face-to-face contact has the effect that also in case of a change in distance between cutting edges 2 with respect to each other, there is no gap formed in the region of the contact area, but rather, the cutting edges 2 slide on outer conductor 8, which in case of a coaxial cable consists of the shielding braid, and thus there is no change caused in the transition resistance.

As can easily be seen in addition from FIG. 3, connector 9, on the longitudinal sides of its base plate 4, has two lugs 5 each which have cutting edge pairs with different axial distances a, b of the cutting edges 2.

Connector 9 can be assembled from two halves, with one half made from a sheet metal member being assembled with another such half to form connector 9 by arranging the cutting edge pairs in mutually overlapping manner. To this end, the lugs 5 are provided with receiving means 12 adapted to be lockingly engaged by locking noses 13 of the respective other connector half. This construction is particularly advantageous in terms the requirement of an inexpensive design for mass production.

The described embodiment according to the present invention serves for elucidation, but not for restriction. Accordingly, the invention can be implemented in the form of other embodiments without leaving the scope of the invention.

The invention has been described by way of an an embodiment for connecting two coaxial lines. The scope of the invention of course comprises also an embodiment in which a plug (socket or pin plug) having the cutting edge arrangement according to the invention is connected to the conductor.

Furthermore, as regards features not elucidated in more detail hereinbefore, it is expressly referred to the claims and the drawings.

What is claimed is:

1. A connector for RF coaxial lines comprising two connector halves for establishing contact with an outer conductor of the RF coaxial line by means of an insulation displacement connection with at least one cutting edge arranged on each connector half, the cutting edges being arranged opposite each other in staggered and parallel offset manner in the longitudinal axial direction of the outer conductor and, after penetration of the outer insulation of the RF coaxial line, establish a cold-welding type connection with the outer conductor on the end face and at least one adjacent side face thereof, and the cutting edges, in case of a change in distance of their end faces with respect to each other, slide on the outer conductor without a gap being formed between outer conductor and cutting edges.

2. The connector of claim 1, wherein the connector has a plurality of pairs of cutting edges arranged symmetrically with respect to a plane extending perpendicularly to the longitudinal axial direction of the outer conductor.

3. The connector of claim 1, wherein the connector has a plurality of pairs of cutting edges which are arranged symmmetrically with respect to a plane extending along the longitudinal axial direction of the outer conductor and which, in case of a change in distance of their end faces with respect to each other, slide on the outer conductor without a gap being formed between outer conductor and cutting edges.

4. The connector of claim 1, wherein a base plate formed on its longitudinal side with lugs extending substantially perpendicularly thereto, with one cutting edge pair each being arranged substantially perpendicularly thereto and extending away therefrom towards the outer conductor.

5. The connector of claim 4, wherein at least two lugs each on both longitudinal sides of the base plate, said lugs having cutting edge pairs with different axial distances of the cutting edges.

6. The connector of claim 4, wherein two connector halves are arranged on the RF line, with the cutting edge pairs overlapping each other.

7. An electrical contact for making connection to a coaxial cable outer conductor, where the coaxial cable is comprised of an inner signal conductor, an inner core surrounding the signal conductor, conductive shielding surrounding the inner core and outer insulation surrounding the inner core, the contact comprising at least one upstanding side edge portion formed by first and second portions, said first and second portions have side faces generally aligned along a vertical axis, and further comprising end faces closely spaced from one another which are axially staggered in the axial direction of the cable, the side faces being profiled for cutting through the outer insulation and the end faces trapping the conductive shielding therebetween.

8. The electrical contact of claim 7, wherein said first and second portions are defined as cutting walls which extend in general transverse relation to said axial direction.

9. The electrical contact of claim 8, wherein a second upstanding side edge portion extends on an opposite side, forming opposed side edge portions, having parallel side faces extending along parallel vertical axes.

10. The electrical contact of claim 9, wherein a plurality of opposed side edge portions generally extend along axial lengths of said contact.

11. The electrical contact of claim 7, wherein the contact is generally rectangular in cross-section.

12. The electrical contact of claim 11, wherein said at least one side edge portion is positioned on at least end of said contact.

13. The electrical contact of claim 12, wherein said at least one side edge portion is at both ends of said contact.

14. The electrical contact of claim 13, wherein said contact is defined by at least two lugs axially spaced apart, wherein said side edge portions extend from said lugs.

* * * * *